US006339059B1

(12) United States Patent
Appel et al.

(10) Patent No.: US 6,339,059 B1
(45) Date of Patent: Jan. 15, 2002

(54) DETERGENT COMPOSITIONS

(75) Inventors: Peter William Appel; Jelles Vincent Boskamp; Anshu Mali Gupta; Christophe Michel Joueux; Marcel van der Kraan; Henning Wagner, all of Vlaardingen (NL)

(73) Assignee: Unilever Home & Personal Care, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/484,812

(22) Filed: Jan. 18, 2000

(30) Foreign Application Priority Data

Jan. 26, 1999 (GB) ..... 9901688

(51) Int. Cl.[7] ..... C11D 13/18

(52) U.S. Cl. ..... 510/446; 510/296; 510/298; 510/349; 510/396; 510/438; 510/440; 510/441; 510/445; 510/447; 510/449

(58) Field of Search ..... 510/296, 298, 510/349, 396, 438, 440, 441, 445, 446, 447, 449

(56) References Cited

U.S. PATENT DOCUMENTS

| | | | | |
|---|---|---|---|---|
| 4,767,559 A | | 8/1988 | Kruse et al. | 252/106 |
| 5,580,392 A | | 12/1996 | Sulc et al. | 134/7 |
| 5,759,974 A | | 6/1998 | Menke | 510/191 |
| 6,051,545 A | * | 4/2000 | Boskamp | 510/446 |

FOREIGN PATENT DOCUMENTS

| | | | |
|---|---|---|---|
| DE | 197 54 292 | | 6/1999 |
| DE | 298 23 505 | | 6/1999 |
| DE | 298 23 506 | | 6/1999 |
| DE | 299 11 485 | | 11/1999 |
| DE | 299 11 486 | | 11/1999 |
| DE | 299 11 487 | | 11/1999 |
| DE | 298 23 942 | | 1/2000 |
| EP | 466 484 | | 1/1992 |
| EP | 0 481 793 | | 4/1992 |
| EP | 711 827 | | 5/1996 |
| EP | 779807 | * | 6/1997 |
| EP | 0 779 807 | | 6/1997 |
| EP | 0 896 053 | | 1/1999 |
| FR | 2458582 | | 2/1981 |
| FR | 2545499 | | 11/1984 |
| FR | 2570079 | | 3/1986 |
| FR | 2695134 | | 3/1994 |
| GB | 911204 | | 11/1962 |
| GB | 2 340 842 | | 3/2000 |
| WO | 97/03177 | | 1/1997 |
| WO | 98/24873 | | 6/1998 |
| WO | 98/42817 | | 10/1998 |
| WO | 98/46719 | | 10/1998 |
| WO | 98/55590 | * | 12/1998 |
| WO | 99/06522 | | 2/1999 |
| WO | 99/27068 | | 6/1999 |
| WO | 99/37746 | | 7/1999 |
| WO | 99/40172 | | 8/1999 |
| WO | 99/55823 | | 11/1999 |

OTHER PUBLICATIONS

PCT International Search Report in a PCT application PCT/EP 99/10457.
Derwent Abstract of DE 299 11 487—Nov. 25, 1999.
Derwent Abstract of DE 299 11 485—Nov. 25, 1999.
Derwent Abstract of DE 197 54 292—Jun. 10, 1999.
DM/044,197, International Designs Bulletin, Jun. 2, 1998.
DM/044,927, International Designs Bulletin, Aug. 21, 1998.
Designs et Modeles publies, BOPI 98/20, pp. 351–356, Oct. 2, 1998.
Boletin Oficial De La Propiedad Industrial, #142828, pp. 3080–3081, Aug. 1, 1998.
Unilever Community Trade Mark application, Mar. 5, 1998, reference #CTM/RA/5MB/TAB1/001.
Derwent abstract of EP 0 779 807, Jun. 25, 1997.
Derwent abstract of WO 97/03177, Jan. 30, 1997.
Derwent abstract of FR2695134, Mar. 4, 1994.
Derwent abstract of FR 25700079, Mar. 14, 1986.
Derwent abstract of FR 2545499, Nov. 9, 1984.
Derwent abstract of FR 2458582, Feb. 6, 1981.
Derwent abstract of DE 298 23 505, Jun. 17, 1999.
Derwent abstract of DE 298 23 506, Jun. 17, 1999.
Derwent abstract of DE 299 11 486, Nov. 18, 1999.
Derwent abstract of DE 298 23 942, Jan. 20, 2000.

* cited by examiner

*Primary Examiner*—Mark Kopec
*Assistant Examiner*—Charles Boyer
(74) *Attorney, Agent, or Firm*—Rimma Mitelman

(57) ABSTRACT

A detergent tablet having at least two discrete regions each compacted from particulate composition, wherein a first said region consists of a compacted particulate composition containing swelling disintegrant such that the region increases in volume on contact with water, and in at least one direction through said region is flanked on both sides by one or more other regions which swell to a lesser extent on contact with water than said first region.

15 Claims, 7 Drawing Sheets

Figure 1A:
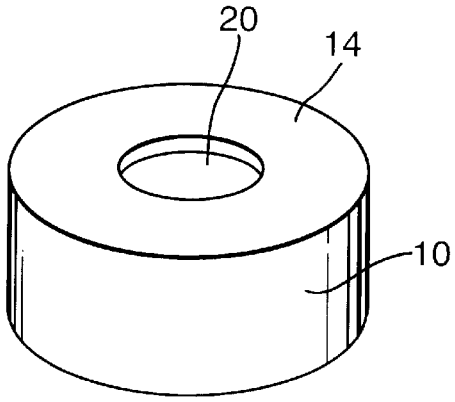

32
30
36
42

50
36
42

40
34
50
30
36
42

34
36
42

12
12
36
42

DETERGENT COMPOSITIONS

The present invention is concerned with detergent compositions in the form of tablets. These tablets may be for the purpose of fabric washing in a laundry washing machine, for dish washing in a mechanical dish washer or for some other cleaning function.

It is desirable that tablets should have adequate mechanical strength when dry, before use, yet disintegrate and disperse/dissolve quickly when added to wash water. It has not proved simple to achieve both properties simultaneously. As more pressure is used when a tablet is compacted, so the tablet density and strength rise, but the speed of disintegration/dissolution when the tablet comes into contact with wash water goes down.

Tablets of detergent composition may be "homogenous" tablets in which the entire tablet consists of a single composition compacted into tablet form. However the present invention is concerned with "heterogenous tablets" in which the tablet is subdivided into more than one separate region and is made from more than one composition. Tablets which are "heterogenous" in that they are subdivided into two layers have been marketed commercially.

The use of swelling disintegrants to enhance the disintegration rate of one region of a detergent tablet relative to another region was disclosed in our WO 98/55590, wherein a higher concentration of water-insoluble swelling disintegrant in one region compared to another region, caused the former region to dissolve/disperse faster than the latter region.

It has now been found that by making the inner region of a detergent tablet swell to a greater extent than the regions surrounding it, the rate of dissolution/dispersion of the whole tablet can be improved.

Accordingly, the present invention provides a detergent tablet having at least two discrete regions each compacted from particulate composition, wherein a first said region consists of a compacted particulate composition containing swelling disintegrant such that the region increases in volume on contact with water, and in at least one direction through said region is flanked on both sides by one or more other regions which swell to a lesser extent on contact with water than said first region.

It is preferred that the one or more other regions contain a lower concentration of swelling disintegrant than the first region, or no swelling disintegrant at all. The ratio of concentrations of swelling disintegrant between the first region, and the one or more other regions is at least greater than 1:1, preferably greater than 3:1 or even 7:1.

In particular, if the one or more other regions contain the same swelling disintegrant which is in the first region, then the concentration of said swelling disintegrant is lower in the one or more other regions than in the first region.

However, it is also envisaged that the one or more other regions may contain an equal or greater concentration of swelling disintegrant than the first region, but in this case the swelling disintegrant or disintegrants in the one or more other regions will have a lower swelling capacity than the swelling disintegrant in the first region. The ratios of swelling capacity between the first region, and the one or more other regions is at least greater than 1:1, preferably greater than 3:1 or even 7:1.

Tablet Forms

The invention encompasses a number of tablet forms are these are discussed below.

In one form, the tablet has a pair of opposite faces spaced apart from each other and joined by a peripheral surface of the tablet, wherein said first region provides a first part of a said face and said one or more further regions provide an adjoining part of said face.

The said face may be substantially flat, or the arrangement may be such that the first part of the face is not at the same level as the adjacent part(s), so that there is a step at the junction of the parts. Even if the two parts are at substantially the same level there is likely to be a groove, a slight step or a line in the surface at their junction.

The first part may stand out from the adjacent part of the end face or it may be inset from the adjacent part of the end face.

Preferably the first region is a core which is entirely surrounded by said one or more other regions of the tablet. A single such surrounding region may provide the entire peripheral surface of the tablet and the remainder of the tablet end faces. Other arrangements are conceivable. A region surrounding a core might possibly be split into two or more, such as three, layers, and the core could itself have two layers.

In a preferred arrangement the first region extends through the tablet so as to be visible at both faces, and may be inset from the surrounding part of each face. Another possibility is that such a region could be visible as part of one face yet extend only part way through the tablet, so that subdivision into regions would not be visible at the opposite face of the tablet.

An alternative arrangement is where the first region extends across the whole width of the tablet, such that the first region forms part of the peripheral surface of the tablet.

A region such as a core which provides a first part of a tablet face adjoined or surrounded by a larger second part of the face, is likely to constitute from 10% or 15% up to 35% or 40% of the tablet weight and from 10% or 15% up to 35% or 40% of the area of the tablet face.

One particularly preferred method of making such tablets comprises the steps of:

- introducing at least one particulate composition into a mould cavity around a plunger which projects into or through the cavity, followed by driving at least one punch onto the compositions around the plunger in the cavity, thereby compacting them into an outside zone of the tablet
- withdrawing the plunger from within the compacted compositions, introducing a further particulate composition into the space vacated by the plunger, and urging at least one plunger against the composition introduced into this space, so as to compact it into an inner zone of the tablet.

There is no need to apply any substantial compaction pressure to the compositions in the outer zone when compacting the further composition, thus allowing the compaction pressure applied to each of the two zones of the tablet to be chosen independently. However, some light pressure may be applied to the (already compacted) compositions in the outer zone to hold them steady while the further composition in the inner zone is compacted.

Preferably the process is carried out using a pair of punches which are relatively movable towards each other within the mould cavity and away from each other, wherein each punch encloses or at least partially surrounds a plunger movable axially relative to the punch. During the first compaction step one or both punches may move. During the second compaction step one or both plungers may move. Conveniently, the particulate compositions of the outer zone would be delivered into the mould cavity above one punch while the plunger associated with that punch project upwardly from it so as to be surrounded by the particulate compositions. If more than one particulate composition is introduced into the outer zone, it is preferred that they are introduced sequentially, so as to produce layers of varying composition. Compaction of the particulate compositions in the outer zone would then be carried out by urging the two punches relatively towards each other, although one may remain stationary relative to the mould cavity if desired. Compaction of the particulate composition in the inner zone would be carried out by urging the two plungers relatively towards each other, although again one may be driven towards the other which remains immobile.

Such a process is preferably carried out using a rotary tableting press in which a rotary table defines a plurality of mould cavities and in which a pair of punches each with a respective axially movable plunger is associated with each mould cavity.

An advantage of the process of this invention is that the core region and surrounding region of the tablet can both be compacted from powder compositions within a single mould cavity. There is no necessity to prefabricate a core region in one mould cavity and somehow position it within another mould cavity. A further advantage is that the tableting pressures applied to each of the compositions can be chosen independently.

The process may lead to tablets in which the compacted further composition provides a part of at least one tablet face which is inset from an adjacent or surrounding part of the tablet face provided by the compositions of the outer zone.

A further form of tablet which is preferred is a tablet with at least three 'layers'. The term 'layers' relates to regions of a detergent tablet that are substantially parallel with the compaction faces of the tablet, i.e. those faces to which the compaction force was applied. In such a tablet, the first region is a layer which is flanked on either side by layers which swell to a lesser extent on contact with water than the first region.

Therefore, in a three layer tablet, the first region will be the central layer, whilst the outer two layers will swell to a lesser extent than the central layer on contact with water.

Manufacture of a tablet with at least three layers of differing composition may be carried out by placing a predetermined quantity of one composition in a mould, then adding a second composition on top, followed by third and further compositions, and next driving a die into the mould to cause compaction.

Alternatively, a predetermined quantity of a composition may be placed in a mould and compacted by driving a die into the mould, followed by removing the die, adding a second composition and compacting again, and repeating as necessary.

Tableting machinery able to carry out such operations is known, for example suitable tablet presses are available from Fette and from Korch.

A further form of tablet useful in the invention is one with an 'invisible' core, which is a region located within the inside of a tablet and which is not visible on the tablet's periphery. This core is the first region, and is completely surrounded by at least one or more other regions which swell to a lesser extent on contact with water than the first region.

Tablets of the invention may be cylindrical, cuboid or they have more unusual shapes, in particular with rounded, rather than flat, surfaces.

Swelling Disintegrant

Swelling disintegrants are materials which swell when in contact with water, thus subjecting the compacted tablet composition to internal pressure.

A number of materials are known for use as swelling disintegrants in pharmaceutical tablets and these may be used in detergent tablets of this invention (See Handbook of Pharmaceutical Excipients, 2$^{nd}$ Edition, American Pharmaceutical Association, pp. 141 et seq. (1994)).

Examples include organic materials such as starches, for example, corn, maize, rice and potato starches and starch derivatives, such as Primojel (Trade Mark) carboxymethyl starch and Explotab (Trade Mark) sodium starch glycolate; celluloses and cellulose derivatives, for example, Courlose (Trade Mark) and Nymcel (Trade Mark) sodium carboxymethyl cellulose, Nylin (Trade Mark) cross-linked sodium carboxymethyl cellulose, Ac-di-Sol (Trade Mark) cross-linked modified cellulose, and Hanfloc (Trade Mark) microcrystalline cellulosic fibres; and various synthetic organic polymers, notably cross-linked polvinyl pyrrolidone, for example, Polyplasdone (Trade Mark) Xl or Kollidon (Trade Mark) CL.

Inorganic swelling disintegrants include bentonite clay, and are generally silica based compounds.

CONSTITUENT MATERIALS

A number of materials which may be utilised to make regions of detergent tablets will now be discussed.

Organic Surfactant

Tablets of this invention will generally contain organic surfactant. This will come from one or more of the categories of surfactant used in detergent compositions for fabric washing. These are most usually anionic and nonionic surfactants and mixtures of the two. Amphoteric (including zwitterionic) and less commonly cationic detergents can also be used.

Anionic Surfactant Compounds

Synthetic (i.e. non-soap) anionic surfactants are well known to those skilled in the art. The anionic surfactant may comprise, wholly or predominantly, linear alkyl benzene sulphonate of the formula

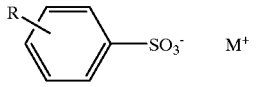

where R is linear alkyl of 8 to 15 carbon atoms and $M^+$ is a solubilising cation, especially sodium.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is also commercially significant as an anionic surfactant and may be used in this invention.

Frequently, such linear alkyl benzene sulphonate or primary alkyl sulphate of the formula above, or a mixture thereof will be the desired non-soap anionic surfactant and may provide 75 to 100 wt % of any anionic non-soap surfactant in the composition.

Examples of other non-soap anionic surfactants include olefin sulphonates; alkane sulphonates; dialkyl sulphosuccinates; and fatty acid ester sulphonates.

One or more soaps of fatty acids may also be included in addition to non-soap anionic surfactant. Examples are sodium soaps derived from the fatty acids from coconut oil, beef tallow, sunflower or hardened rapeseed oil.

Nonionic Surfactant Compounds

Nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Amphoteric Surfactants

Amphoteric surfactants which may be used jointly with anionic or nonionic surfactants or both include amphopropionates of the formula:

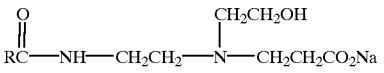

where RCO is a acyl group of 8 to 18 carbon atoms, especially coconut acyl.

The category of amphoteric surfactants also includes amine oxides and also zwitterionic surfactants, notably betaines of the general formula

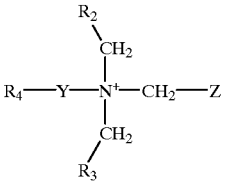

where $R_4$ is an aliphatic hydrocarbon chain which contains 7 to 17 carbon atoms, $R_2$ and $R_3$ are independently hydrogen, alkyl of 1 to 4 carbon atoms or hydroxyalkyl of 1 to 4 carbon atoms such as $CH_2OH$;

Y is $CH_2$ or of the form $CONHCH_2CH_2CH_2$ (amidopropyl betaine);

Z is either a $COO^-$ (carboxybetaine), or of the form $CHOHCH_2SO_3$—(sulfobetaine or hydroxy sultaine).

Another example of amphoteric surfactant is amine oxide of the formula

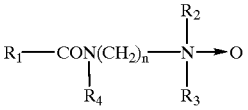

where $R_1$ is $C_{10}$ to $C_{20}$ alkyl or alkenyl $R_2$, $R_3$ and $R_4$ are each hydrogen or $C_1$ to $C_4$ alkyl while n is from 1 to 5.

Detergency Builder

Tablets of this invention will generally include a water-soluble or water-insoluble detergency builder or a mixture of the two.

Water-soluble phosphorus-containing inorganic detergency builders include the sodium and potassium orthophosphates, metaphosphates, pyrophosphates and polyphosphates.

Alkali metal aluminosilicates are strongly favoured as environmentally acceptable water-insoluble builders for fabric washing. Alkali metal (preferably sodium) aluminosilicates may be either crystalline or amorphous or mixtures thereof, having the general formula:

$$0.8–1.5Na_2O.Al_2O_3.\ 0.8–6SiO_2.xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the zeolite P described and claimed in EP 384070 (Unilever) which is also referred to as zeolite MAP and mixtures thereof. Zeolite MAP is available from Crosfields under their designation Zeolite A24.

Conceivably, water-insoluble detergency builder could be a crystalline layered sodium silicate as described in U.S. Pat. No. 4,664,839.

NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, which can be used have the general formula $NaMSi_xO_{2x+1}.yH_2O$ wherein M is sodium or hydrogen, x is a number from 1.9 to 4, preferably 2, and y is a number from 0 to 20, preferably 0.

Crystalline layered silicate may be used in the form of granules which also contain citric acid.

Non-phosphorous water-soluble builders may be organic or inorganic. Inorganic builders that may be present include alkali metal (generally sodium) carbonate; while organic builders include polycarboxylate polymers, such as polyacrylates and acrylic/maleic copolymers, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Alkali metal silicate, particularly sodium ortho-, meta- or disilicate has detergency building properties and may be used in substantial quantity in tablets for machine dishwashing. It is desirably included in smaller quantities in tablets for fabric washing. The presence of such alkali metal silicates may be advantageous in providing protection against the corrosion of metal parts in washing machines, besides providing some detergency building.

Tablet compositions preferably include polycarboxylate polymers, more especially polyacrylates and acrylic/maleic copolymers which can function as builders and also inhibit unwanted deposition onto fabric from the wash liquor.

If a composition is formulated to have low phosphate, the amount of inorganic phosphate builder may be less than 5 wt % of the tablet composition.

Bleach System

Detergent tablets according to the invention may contain a bleach system. This preferably comprises one or more peroxy bleach compounds, for example, inorganic persalts or organic peroxyacids, which may be employed in conjunction with activators to improve bleaching action at low wash temperatures.

Preferred inorganic persalts are sodium perborate monohydrate and tetrahydrate, and sodium percarbonate. These persalts may be provided in coated form, where the coating consists of water-soluble salts.

Bleach activators have been widely disclosed in the art. Preferred examples include peracetic acid precursors, for example tetraacetylethylene diamine (TAED), and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Disintegrants

Tablets of this invention may include further material which functions as a disintegrant, in addition to the swelling disintegrant. It is preferred that further disintegrants are included in the regions with a lower concentration of swelling disintegrant, in order to aid the disintegration and/or dissolution of those regions.

Effervescent Disintegrants

Effervescent disintegrants include weak acids or acid salts, for example, citric acid (preferred), malic acid or tartaric acid, in combination with alkali metal carbonate or bicarbonate; these may suitably be used in an amount of from 1 to 25 wt %, preferably from 5 to 15 wt %. Further examples of acid and carbonate sources and other effervescent systems may be found in Pharmaceutical Dosage Forms: Tablets, Volume 1, 1989, pages 287–291 (Marcel Dekker Inc, ISBN 0-8247-8044-2).

Water-soluble Disintegrants

Such materials include compounds of high water-solubility, a specified form of sodium tripolyphosphate and combinations of these two. Such material may be present as at least 10 or 15% of the composition of a tablet or region thereof, possibly at least 25% up to 50 or 60%, possibly more.

Highly water soluble materials, which are one of the two possibilities are compounds, especially salts, with a solubility at 20° C. of at least 50 grams per 100 grams of water. Such materials have been mentioned in our published patent applications including EP-A-711827 and EP-A-838519. A solubility of at least 50 grams per 100 grams of water at 20° C. is an exceptionally high solubility: many materials which are classified so as water soluble are less soluble than this.

Some highly water-soluble materials which may be used are listed below, with their solubilities expressed so as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |

-continued

| Material | Water Solubility (g/100 g) |
|---|---|
| Sodium acetate, anhydrous | 119 |
| Sodium acetate trihydrate | 76 |
| Magnesium sulphate $7H_2O$ | 71 |
| Potassium acetate | >200 |

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium tripolyphosphate anhydrous | 15 |

Preferably this highly water soluble material is incorporated so as particles of the material in a substantially pure form (i.e. each such particle contains over 95% by weight of the material). However, the said particles may contain material of such solubility in a mixture with other material, provided that material of the specified solubility provides at least 50% by weight of these particles, better at least 80%.

A particularly preferred material, sodium acetate trihydrate, is normally produced by a crystallisation process, so that the crystallised product contains 3 molecules of water of crystallisation for each sodium and acetate ion pair. Sodium acetate in an incompletely hydrated form, which may be produced by a spray-drying route, can also be used.

Another possibility is that the said particles which promote disintegration are particles containing sodium tripolyphosphate with more than 50% of it (by weight of the particles) in the anhydrous phase I form. Such particles may contain at least 80% by weight tripolyphosphate and possibly at least 95%. Detergent tablets containing such material are the subject of our EP-A-839906.

Sodium tripolyphosphate is very well known so as a sequestering builder in detergent compositions. It exists in a hydrated form and two crystalline anhydrous forms. These are the normal crystalline anhydrous form, known so as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4536377.

Particles which contain this phase I form will often contain the phase I form of sodium tripolyphosphate so as at least 55% by weight of the tripolyphosphate in the particles. Other forms of sodium tripolyphosphate will usually be present to a lesser extent. Other salts may be included in the particles, although that is not preferred.

Desirably, this sodium tripolyphosphate is partially hydrated. The extent of hydration should be at least 1% by weight of the sodium tripolyphosphate in the particles. It may lie in a range from 2.5 to 4%, or it may be higher, e.g. up to 8%.

Suitable material is commercially available. Suppliers include Rhone-Poulenc, France and Albright & Wilson, UK.

"Rhodiaphos HPA 3.5" from Rhone-Poulenc has been found particularly suitable. It is a characteristic of this grade of sodium tripolyphosphate that it hydrates very rapidly in a standard Olten test. We have found that it hydrates so as quickly so as anhydrous sodium tripolyphosphate, yet the prehydration appears to be beneficial in avoiding unwanted crystallisation of the hexahydrate when the material comes into contact with water at the time of use.

Polymer Binder

Tablets of this invention may include an organic water-soluble polymer, serving as a binder when the particles are compacted into tablets. This polymer may be a polycarboxylate included as a supplementary builder, as mentioned earlier. It may be applied as a coating to some or all of the constituent particles prior to compaction.

As taught in our EP-A-522766, such polymers can function to enhance tablet disintegration at the time of use, as well as acting as a binder to enhance tablet strength prior to use.

It is preferred that such a binder material, if present, should melt at a temperature of at least 35° C., better at 40° C. or above, which is above ambient temperatures in many temperate countries. For use in hotter countries it will be preferred that the melting temperature is somewhat above 40° C., so as to be above the ambient temperature.

For convenience the melting temperature of the binder material should be below 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycol of higher molecular weight, notably 4000 or 6000, can also be found.

Other possibilities are polyvinylpyrrolidone, and polyacrylates and water-soluble acrylate copolymers.

The binder may suitably be applied to the particles by spraying, e.g. so as a solution or dispersion. It may be applied to particles which contain organic surfactant. If used, the binder is preferably used in an amount within the range from 0.1 to 10% by weight of the tablet composition, more preferably the amount is at least 1% or even at least 3% by weight of the tablets. Preferably the amount is not over 8% or even 6% by weight unless the binder serves some other additional function.

Other Ingredients

The detergent tablets of the invention may also contain one of the detergency enzymes well known in the art for their ability to degrade various soils and stains and so aid in their removal. Suitable enzymes include various proteases, cellulases, lipases, amylases, oxidases and mixtures thereof, which are designed to remove a variety of soils and stains from fabrics or from tableware during dishwashing. Cellulases have a fabric softening function also. Detergency enzymes are commonly employed in the form of particles or marumes, optionally with a protective coating, in amount of from about 0.01% often from 0.1% to about 3% by weight of the tablet. A total enzyme content may exceed 3% but is unlikely to exceed 5%. The amount of any one enzyme is likely to lie in a range from 0.01% to 3% by weight of the tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Antifoam materials in granular form are described in EP 266863A (Unilever). Such antifoam particles typically comprise a mixture of silicone oil, petroleum jelly, hydrophobic silica and alkyl phosphate so as antifoam active material, sorbed onto a porous absorbed water-soluble carbonate-based inorganic carrier material.

Further ingredients which can optionally be employed in fabric washing detergent tablet of the invention include anti-redeposition agents such so as sodium carboxymethylcellulose, straight-chain polyvinyl pyrrolidone (which can also act as a binder, as mentioned earlier) and the cellulose ethers such as methyl cellulose and ethyl hydroxyethyl cellulose, heavy metal sequestrants such as EDTA; perfumes; fabric softening and/or conditioning agents; soil release polymers and colorants or coloured speckles.

Proportions and Tablet Types

A tablet of this invention intended for fabric washing will generally contain, overall,

- at least 5%, better at least 8%, up to not over 50%, possibly not over 30 or 40%, by weight of non-soap organic detergent which is preferably a combination of anionic and nonionic detergents;
- at least 15%, better at least 20 or 25%, up to 80%, possibly not over 70 or 60% by weight of one or more detergency builders which may be water-soluble, water-insoluble or a mixture of soluble and insoluble builders;
- optionally other ingredients which may amount to at least 10% by weight of the tablet.

The amount of anionic surfactant is likely to be from 5 to 50% by weight of the overall tablet composition while the amount of nonionic surfactant is likely to be from 2% to 40%, better from 4 or 5% up to 30% by weight of the overall tablet. Soap may be included in addition to non-soap anionic surfactant.

A tablet of this invention intended for machine dishwashing, will generally be formulated with a small percentage of nonionic surfactant present such so as 1 to 8% by weight, from 20 to 99% detergency builder, and possibly no anionic detergent at all.

The discrete regions of a tablet may have compositions which lie outside the stated ranges. However, the compositions of regions may well individually conform with the ranges indicated above for a complete tablet of the appropriate character, i.e. machine dishwashing or fabrics washing.

It is likely that each discrete region of a tablet will provide from 5% to 95% of the tablet weight, more preferably from 10 to 80% and likewise from 5 or 10% up to 80% or even 95% of the area of a tablet face.

If a tablet contains peroxygen bleach, the amount of such bleach in the tablet is likely to be from 10% to 25% by weight of the whole tablet composition. Although peroxygen bleaches can be used without a bleach activator, the amount of bleach activator is likely to be from 1 to 10% by weight of the whole tablet; but if the activator is a transition metal catalyst then the amount present is likely to be from 0.01 to 5% by weight of the whole tablet.

Particle Size and Distribution

The discrete regions of a detergent tablet of this invention, are a matrix of compacted particles. Preferably the particulate mixture of particles, from which each tablet region is compacted, has an average particle size before compaction in the range from 200 to 2000 μm, more preferably from 250 to 1400 μm. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 550 g/liter, and perhaps at least 600 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Porosity

The step of compacting the particles reduces the porosity of the composition. Porosity is conveniently expressed as the percentage of volume which is air.

The air content of a tablet or region of a tablet can be calculated from the volume and weight of the tablet or region, provided the air-free density of the solid content is known. The latter can be measured by compressing a sample of the material under vacuum with a very high applied force, then measuring the weight and volume of the resulting solid.

The percentage air content of a tablet or region of a tablet varies inversely with the pressure applied to compact the composition while the strength of the tablet or region varies with the pressure applied to bring about compaction. Thus the greater the compaction pressure, the stronger the tablet or region becomes but the smaller the air volume within.

The invention may be applied when compacting particulate detergent composition to give tablets with a wide range of porosities. Specifically included among possible porosities is a porosity of up to 38% air volume, e.g. from 10 or 15 better 25% up to 35% air by volume in the tablet.

A number of embodiments of this invention will be described by way of example with reference to the accompanying drawings in which:

DETAILED DESCRIPTIONS OF THE DRAWINGS

Figure 1B:
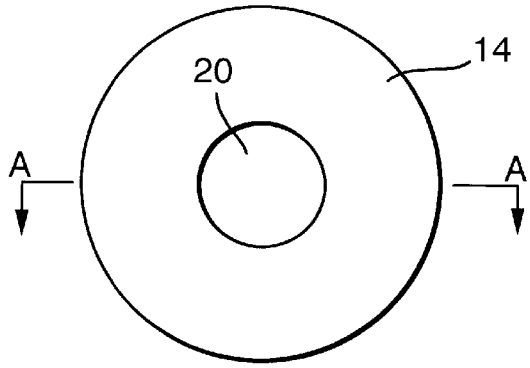
Figure 2:
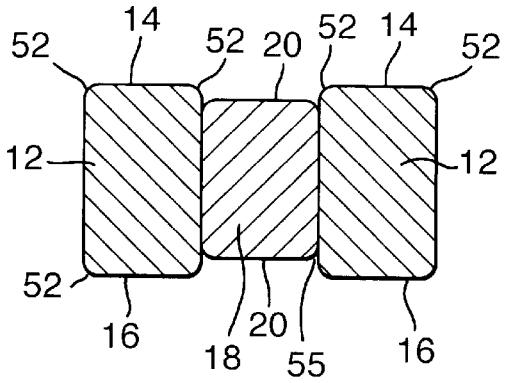
Figure 8:
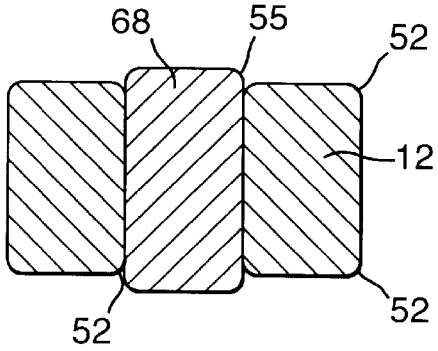
Figure 9:
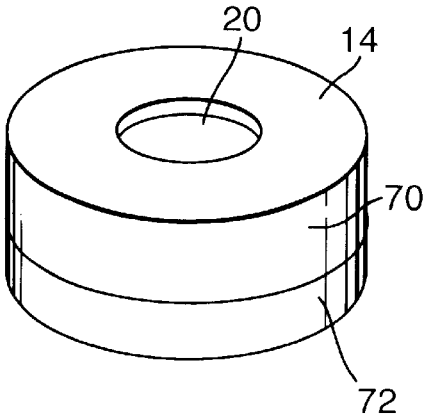
Figure 10:
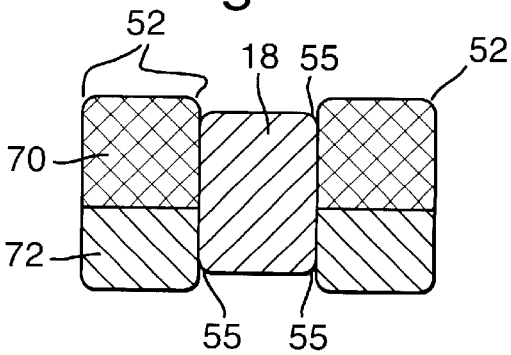
Figure 3A:
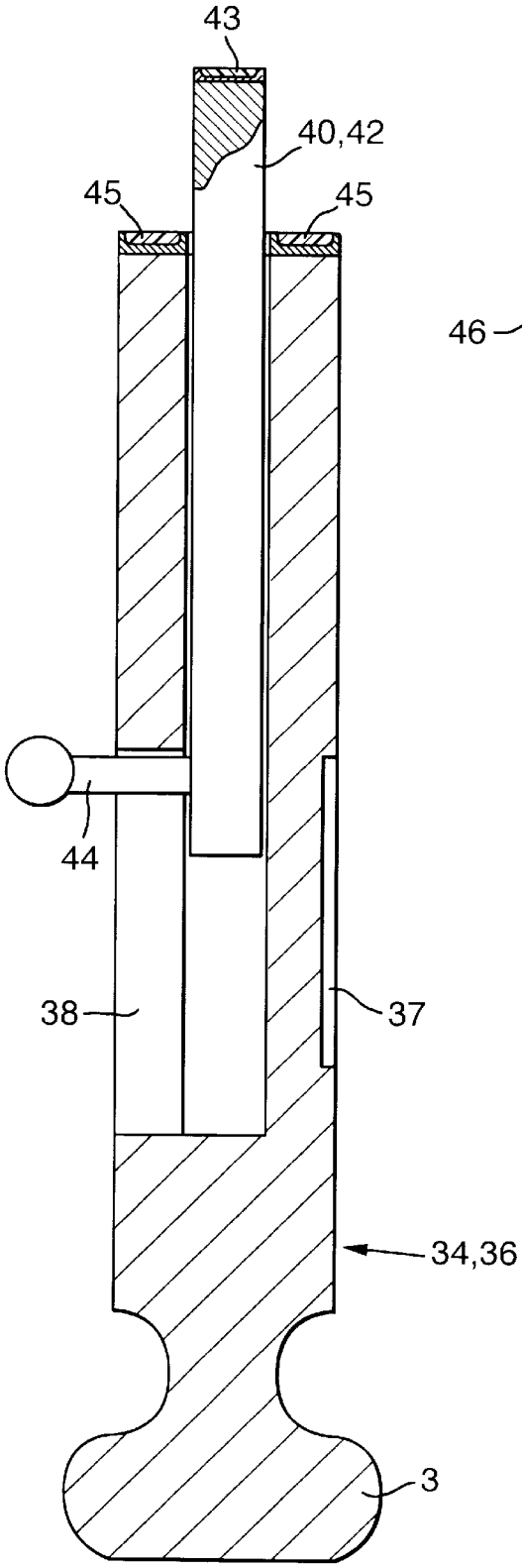
Figure 3B:
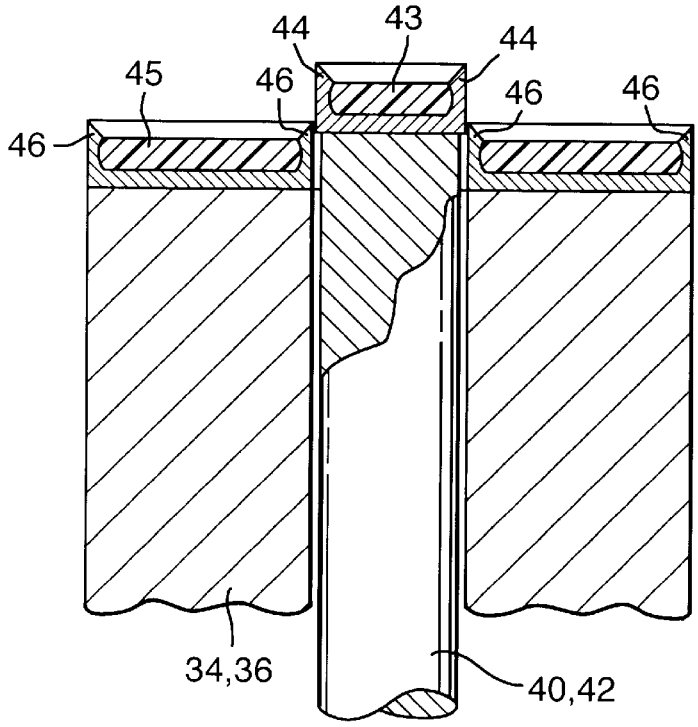

FIGS. 1*a* and 1*b* are perspective and face views of a tablet according to this invention, FIG. 2 is a section on the line AA of FIG. 1*b*, FIG. 3*a* is a sectional view showing a punch and plunger used in tablet manufacture, FIG. 3*b* is an enlarged sectional view showing the operative end parts of a punch and a plunger, FIG. 4 is a diagrammatic illustration of the manufacture of one region of the tablet shown in FIGS. 1 and 2, FIG. 5 diagrammatically illustrates subsequent stages in which a core region is added to the region found in FIG. 3, FIG. 6 shows a variation on FIG. 5, FIG. 7 shows another variation on FIG. 5, FIG. 8 is a sectional view analogous to FIG. 2, of the tablet made by the procedure in FIG. 7, FIGS. 9 and 10 are views, corresponding to FIGS. 1*b* and 2, showing a further form of tablet.

FIGS. 11*a* to 11*d* show tablets of the invention (half only) as discussed in Example 1.

As shown by FIGS. 1 and 2, a tablet embodying the present invention has a generally cylindrical shape with a cylindrical peripheral wall 10. The tablet has an annular surrounding region 12 which provides the peripheral cylindrical surface 10 and annular parts 14,16 of the end faces of the tablet. Located centrally within this region is another discrete region in the form of a cylindrical core 18 which has a pair of end faces 20 recessed inwardly from the end faces 14,16 of the surrounding region.

Tablets as shown in FIGS. 1 and 2 can be made in accordance with the process of this invention using a modified form of rotary tableting press. This is shown by FIGS. 3 to 5.

The tableting press has a rotary table 30 defining a plurality of cavities 32 in which tablet stamping occurs. Associated with each cavity are upper and lower punches 34,36. These move around the table axis in unison with rotation of the table, but can be moved axially relative to the rotary table 30 and each other, so that they can be driven into the cavity in the table or withdrawn from it. Lower punches 36 have the same construction as upper punches 34.

As shown by FIG. 3*a*, each punch 34 or 36 is cylindrical and provided with an end piece 39 which is shaped to engage with a cam track (not shown) for moving the punch towards and away from the rotary table 30 as the table rotates. This is the same as a conventional arrangement for the stamping of homogenous tablets of a single composition using solid punches.

Each punch 34,36 has a central bore accommodating an axially moveable plunger 40,42. Attached to each plunger is an arm 44 projecting radially through a slot 38 in the cylindrical punch to engage another cam track (also not shown) which brings about axial motion of the plunger. Each punch 34,36 also has a keyway 37 into which engages a key (not shown) which serves to constrain the punch against unwanted rotation about its own axis i.e. rotation relative to the rotary table 30.

The end face of each plunger and punch, where the plunger and/or punch respectively contacts the detergent composition could be formed from the solid metal of the punch or plunger. Our published application WO 98/46719 teaches that adhesion of the detergent composition to a punch can be beneficially reduced by providing an elastomeric surface layer to contact the detergent composition. As seen best from FIG. 3*b*, the plunger has an elastomeric surface layer 43 retained by an undercut rim 44 around the operative end of the plunger while the punch has likewise an elastomeric surface layer 45 which is retained by undercut rims 46 around the inner and outer boundaries of the annular operative surface of the punch. These undercut rims 44,46 are best seen in FIG. 3*b*. They have been omitted, for clarity, from the smaller scale FIGS. 4 to 7 which will now be described.

FIGS. 4 and 5 show a succession of stages of rotation of the table 30 and the associated movements of the punches and plungers.

Figures 4A, 4B, 4C, 4D, 4E:
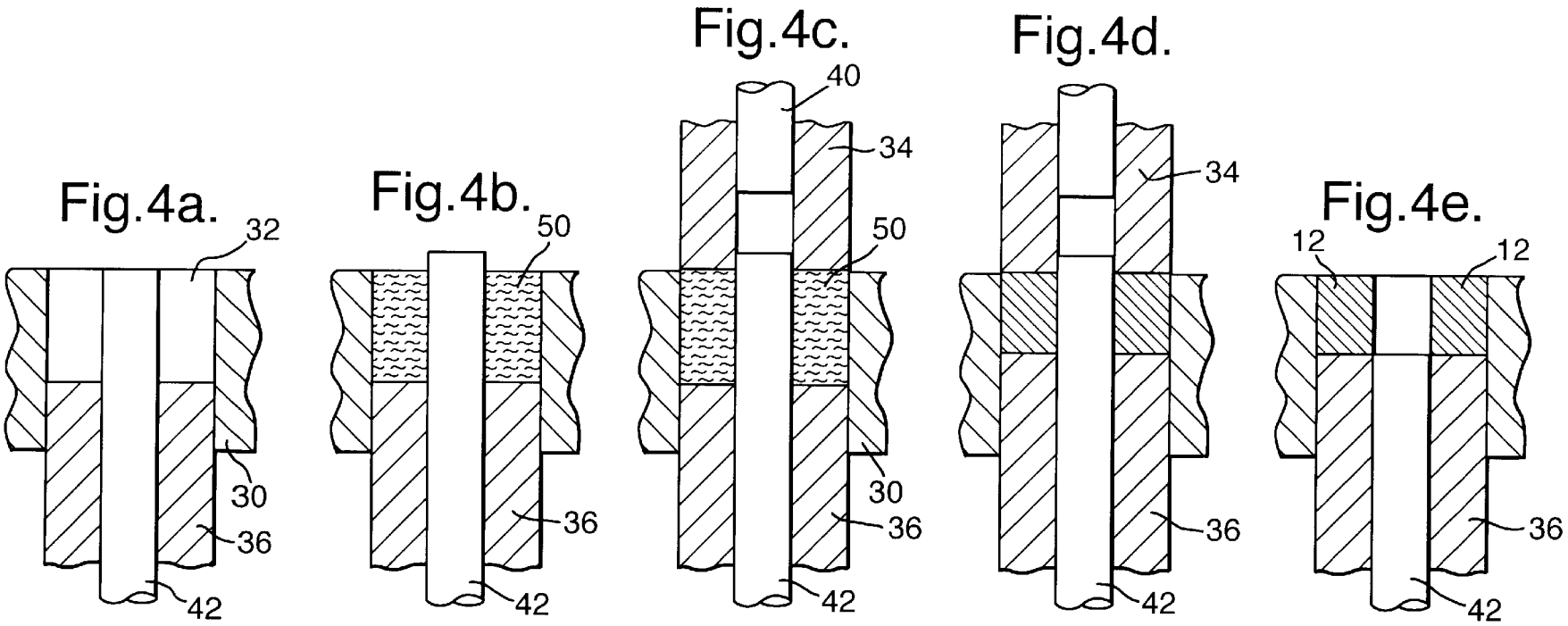

The sequence of operations starts with a lower punch 36 in the position shown at FIG. 4*a* while the associated upper punch 34 is raised out of the way. The plunger 42 in the lower punch 36 is raised to project through the cavity 32 of the rotary tablet. Thus the space around it is annular. As the table rotates, this annular space is filled as shown at FIG. 4*b* with a first detergent composition 50 for compaction and the plunger 42 is raised slightly. Next at FIG. 4*c* the upper punch 34 is brought down on top of the composition 50, after which, at FIG. 4*d* the lower punch 36 is urged upwardly, thus compacting the composition 50 around the raised plunger 42 of the lower punch into an annular region 12 of a tablet. The upper punch 34 is then raised out of the way and the plunger 42 is lowered as shown at FIG. 4*e*.

A detail which is omitted from FIG. 4 is shown in FIG. 2. When the rims 46 on the punches 34,36 contact the composition 50 as it is being compacted, they form indentations 52 encircling the inner and outer edges of the annular faces 14,16 of the region 12.

Subsequent steps take place further on in the rotation of the table 33. As shown at FIG. 5*a*, second composition 54 is introduced into the cavity above the plunger 42. Next at FIG. 5*b* the upper punch 34 is lowered onto the previously formed outer region 12 of the tablet but does not apply any substantial pressure to it. The upper and lower plungers 40,42 are urged towards each other as shown at FIG. 5*c* so that the particulate composition 54 is compacted between these plungers and is also forced radially outwardly into contact with the surrounding region 12 of the tablet.

As the rims 44 on the plungers 40,42 contact the composition 54 which is being compacted, they form indentations 55 encircling the faces 20 of the region 18.

In this way the tablet which is formed has the features shown by FIGS. 1 and 2 with the faces 20 of the central core 18 set inwardly from the outer faces 14, 16 of the surrounding region 12.

Figure 5E:
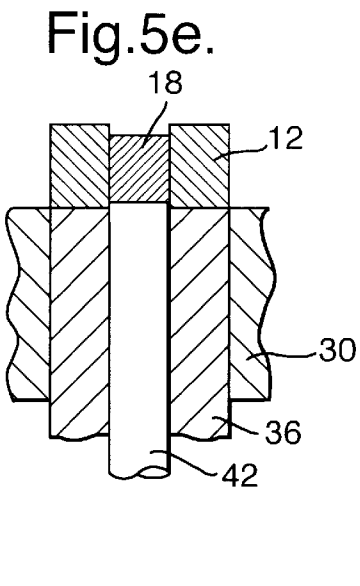
Figure 5D:
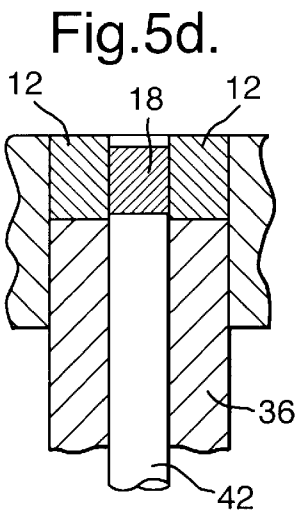
Figure 5C:
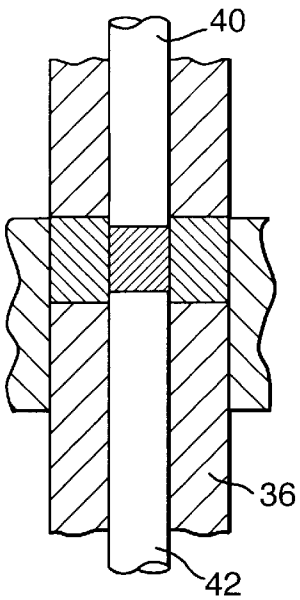
Figure 5B:
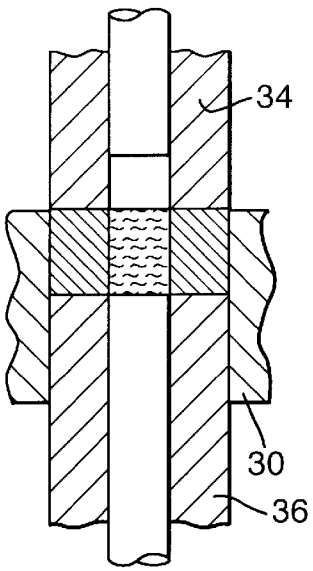
Figure 5A:
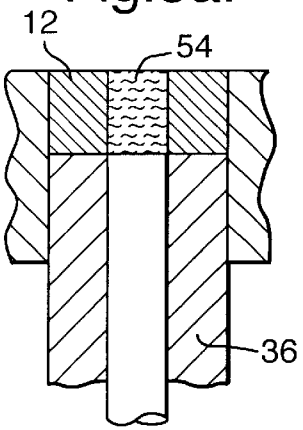

Finally the upper punch 34 is again raised as shown at FIG. 5*d* and the tablet is ejected from the cavity by raising the lower punch 36 and plunger 42 together, as shown at FIG. 5*e*. The lower punch is then lowered to the position shown by FIG. 4*a* for the cycle to be repeated.

Figure 6A:
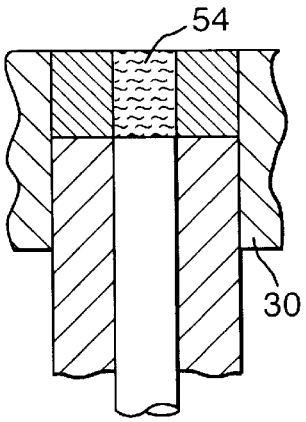
Figure 6B:
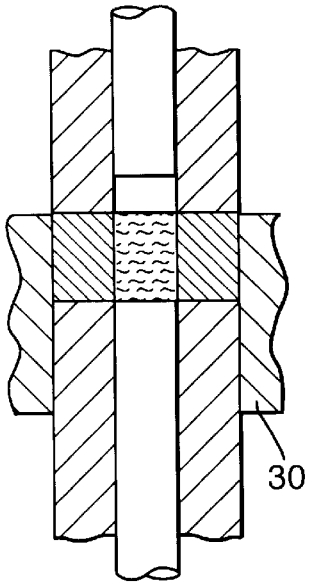
Figure 6C:
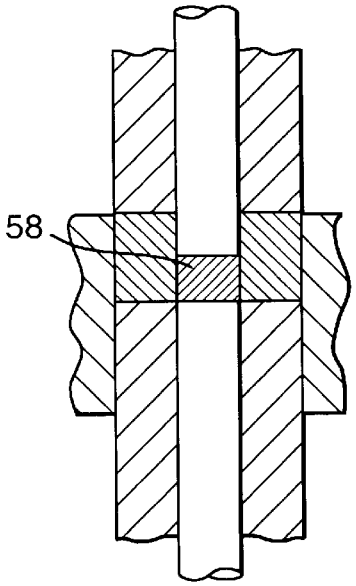
Figure 6D:
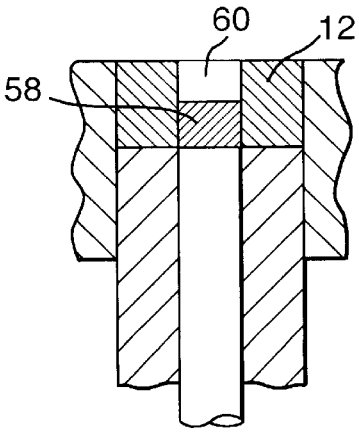
Figure 6E:
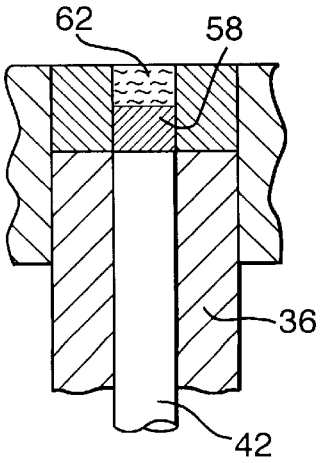
Figure 6F:
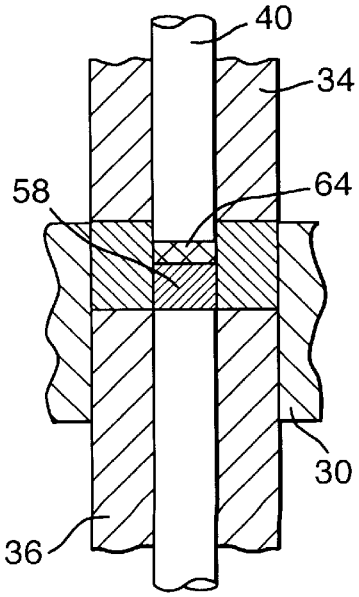

In the variant arrangement shown by FIG. 6, the composition 54 is compacted into a core region 58 by driving the plunger 40 downwardly while the plunger 42 does not more axially, as shown at FIG. 6*c*. The upper punch 34 is then raised out of the way, leaving a cavity 60 above the core region 58 as seen at FIG. 6*d*. As shown at FIG. 6*e* a further composition 62 is introduced into the cavity 60. It is compacted as shown at FIG. 6*f* to form a tablet with an outer region 12 surrounding a central core which has two layers 58,64. The punch 34 is raised and the tablet is ejected by raising the punch 36 and plunger 42 together (not shown).

FIG. 7 shows another variant arrangement leading to the production of a tablet having the form shown in cross-section in FIG. 8. As can be seen in FIG. 8, the tablet has an outer region 12 and an inner core region 68 but the core region 68 stands out from the end faces 14,16 of the first region 12.

Figure 7E:
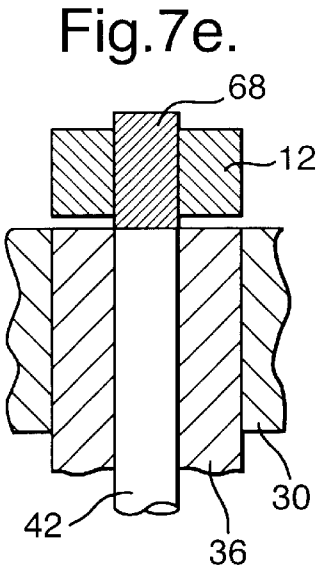
Figure 7D:
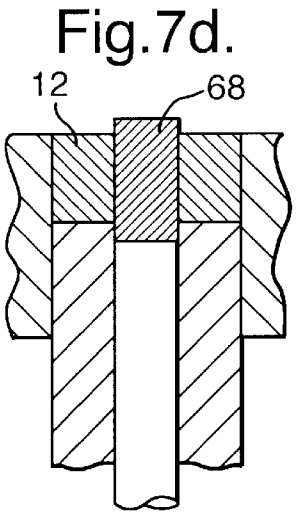
Figure 7C:
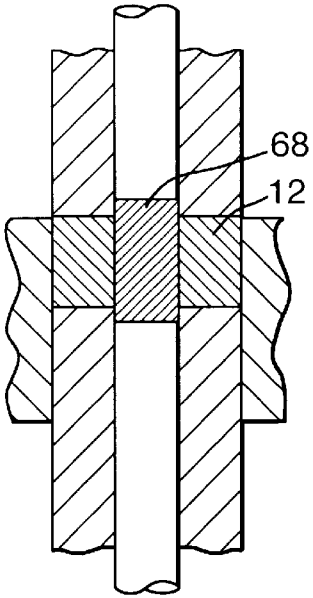
Figure 7B:
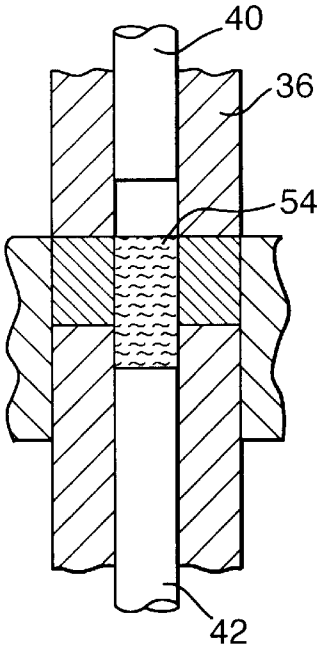
Figure 7A:
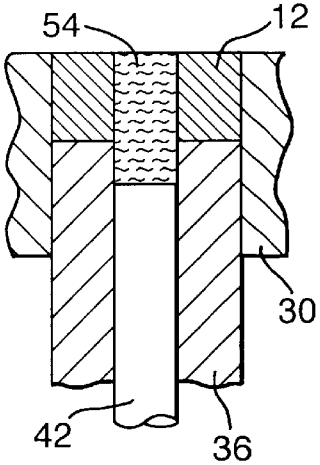
Figure 11A:
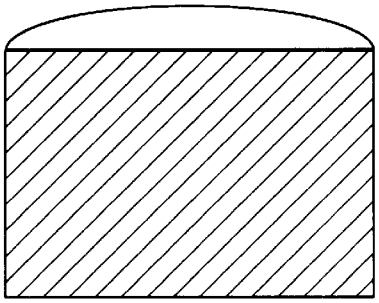
Figure 11B:
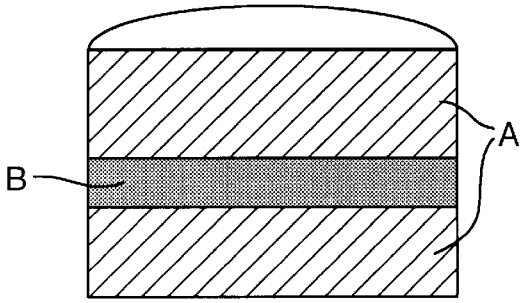
Figure 11C:
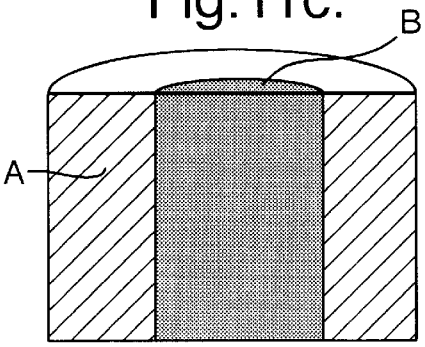
Figure 11D:
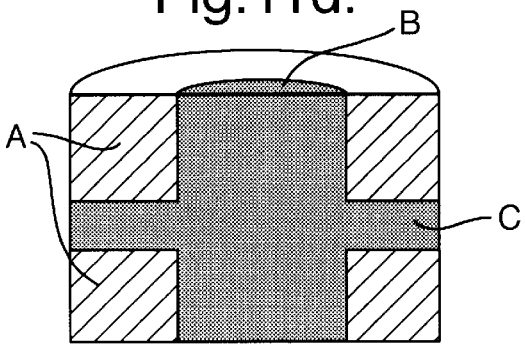

To make this tablet the outer region 12 is first made in accordance with the procedure illustrated by FIG. 4. Next, as shown by FIG. 7*a* the plunger 42 is lowered to below the upper surface of the punch 36. The second detergent composition 54 is filled into the cavity above the plunger 42 which is bounded partially by the upper end portion of the punch 36 and partially by the already formed first region 12. Next as shown at FIG. 7*b*, the upper punch 34 is placed on the already formed region 12 but without applying substantial pressure to it. As shown at FIG. 7*c* the plungers 40,42 are urged together compacting the detergent composition 54 so as to form the core region 68. When the upper punch 34 is raised out of the way as illustrated by FIG. 7*d* the compacted core region 68 stands above the upper surface of the rotary table 30. To eject this tablet from the cavity in the table the lower punch 36 is raised until it is level with the top of the table 30 and the plunger 42 within it is also raised slightly so that it too is level with the top of the table as seen at FIG. 7*e*.

FIG. 6 has already illustrated the manufacture of a tablet according to this invention in which the core region consists of two layers. FIGS. 9 and 10 illustrate a tablet according to this invention in which the core region 18 consists of a single material but this is surrounded by an annular outer portion which is subdivided into two layers 70,72. To manufacture this tablet the outer portion is first manufactured by a variant of the procedure shown in FIG. 4. The procedure begins with the lower punch 36 somewhat raised from the position illustrated in FIG. 4*a* so that the cavity 32 above it is shallower. The plunger 42 is raised level with the top of the rotary table 30 as in FIG. 4*a*. Composition for the layer 72 is filled into the cavity 32, lightly compacted between the punches and pushed downwards in the mould cavity 32 to create an annular cavity around the plunger 42 and above the compacted layer 72. This is filled with composition to form the upper layer 70 and then both the lower layer 72 and the upper layer 70 above it are together compacted between the punches 34,36, analogously to FIGS. 4*c* and 4*d*. After the two layer outer annular portion of the tablet has been formed in this way, the core 18 is formed within it by the procedure of FIG. 5.

Tablets do not need to be cylindrical neither do the core regions within them. Other shapes can be made using punches, plungers and mould cavities of appropriate shape.

EXAMPLE 1

Fabrics washing tablets with the forms illustrated in FIGS. 11*a* to 11*d* (tablets shown cut in half) were prepared with the following formulations. Each region of the tablet comprised a formulation of which the following composition was the main component:

| | % by weight |
|---|---|
| Granulated Components | |
| Linear alkyl benzene sulphonate | 12.8 |
| Nonionic 7EO | 3.8 |
| Zeolite A24 | 23.1 |
| Sodium carbonate | 3.9 |
| Soap | 0.4 |
| SCMC | 0.5 |
| Sodium acetate trihydrate | 3.2 |
| Water | 4.4 |
| Postdosed Components | |
| Sodium percarbonate | 15.8 |
| TAED granule | 4.2 |
| Sodium acetate trihydrate | 17.8 |
| PVP granules | 0.2 |
| Dequest 2047 (EDTMP) | 0.8 |
| Sodium silicate | 2.1 |
| Soil release polymer | 1.2 |
| antifoam | 2.6 |
| Flourescer | 3.2 |
| TOTAL | 100 |

The materials listed as "granulated components" are mixed in a Fukae (Trade Mark) FS-100 high speed mixergranulator. The soap is prepared in situ by neutralisation of fatty acid. The mixture is granulated and densified to give a powder of bulk density greater than 750 g/liter and a mean particle size of approximately 650 μm. The powder is sieved to remove fine particles smaller than 180 μm and large particles exceeding 1700 μm. The remaining solids are then mixed with the powder in a rotary mixer.

This composition was either used alone in a region of the tablet or was supplemented with Nylin (Trade Mark) cross-linked sodium carboxymethyl cellulose and/or further sodium acetate trihydrate. The formulations of the four types of tablet are set out below; the overall composition of each tablet is approximately the same.

Tablet form 1 (FIG. 11*a*) was a homogenous tablet with the same formulation throughout.

Tablet form 2 (FIG. 11*b*) was a three-layer tablet, having a central layer of formulation B (20 wt % of whole tablet), and two equal sized outer layers of formulation A (40 wt % each of whole tablet). This tablet was manufactured by placing the requisite amount of formulation A into the tablet die, followed by formulation B, and followed by the remainder of formulation A, before the whole tablet was compressed.

Tablet form 3 (FIG. 11*c*) was a tablet with a core, with the core being of formulation B (11.2 wt % of whole tablet) and the outer surrounding region being of formulation A (88.8 wt % of whole tablet). This tablet was made by placing an open cylinder in the tablet die, filling this with composition B, filling the surrounding region with composition A, removing the cylinder and then compressing the whole tablet.

Tablet form 4 (FIG. 11*d*) had a core of formulation B (11.2 wt % of whole tablet), and the outer region (88.8 wt % of whole tablet) comprised three layers, the central layer having formulation C (17.8 wt % of whole tablet), and the outer layers having formulation A (35 wt % each of whole tablet). This tablet was made as for tablet form 3, but with the outer region being filled as in tablet form 2.

The tablets were compressed using a Graseby Specac air press P/N-632 at variable compaction forces so as to provide tablets with similar strengths.

| | 1 | 2 | | 3 | | 4 | | |
|---|---|---|---|---|---|---|---|---|
| Option | Whole | A | B | A | B | A | B | C |
| Effective formulation | 95.00 | 76.00 | 19.00 | 84.80 | 10.17 | 66.50 | 10.64 | 16.77 |
| Nylin ™ | 1.00 | — | 1.00 | — | 1.03 | — | 0.56 | 0.53 |
| Extra NaAc | 4.00 | 4.00 | — | 4.00 | — | 3.50 | — | 0.50 |
| Total | 100.00 | 80.00 | 20.00 | 88.80 | 11.20 | 70.00 | 11.20 | 17.80 |

Tablet strength was tested by a procedure in which a cylindrical tablet is compressed radially between the platens of a materials testing machine until the tablet fractures. At failure, the tablet cracks and the applied force needed to maintain the displacement of the platens drops. Measurement is discontinued when the applied force needed to maintain the displacement has dropped by 25% from its maximum value.

The maximum force is the force at failure ($F_{max}$). From this measurement of force a test parameter called diametral fracture stress, was calculated using the equation $$\sigma = 2\frac{F_{\max}}{\pi D t}$$

where σ is the diametral fracture stress in Pascals, $F_{max}$ is the applied force in Newtons to cause fracture, D is the tablet diameter in meters and t is the tablet thickness in meters.

The force to cause fracture and the diametral fracture stress calculated from it are a direct assessment of strength and indicate the tablets' resistance to breakage when handled by a consumer at the time of use. The amount of energy (or mechanical work) put in prior to fracture is a measure of tablet deformability and is relevant to the tablets' resistance to breakage during transport. This energy or work prior to failure is assessed as the "break energy" which is the area under a graph of force against displacement, up to the point of break. It is given by the equation:

$$E_b = \int_0^{x_f} F(x)dx$$

where $E_b$ is the break energy in milijoules, x is the displacement in meters,

F is the applied force in Newtons at displacement x, and $X_f$ is the displacement at failure.

In order to measure the dissolution of the tablets in a washing machine dispenser drawer, a Philips AWB 126/127 dispenser with a shower-type inlet was set up with standard water-inlet conditions of 1 bar pressure, 5 liters/minute flow-rate and a water temperature of 10° C. Two tablets are dosed into the dispenser, and water added for two minutes. The test consists of measuring the wet residue in the dispenser tray (applying a correction factor of 5 g for the weight of water present), and then drying the residue for 24 hours at 100° C. before weighing the residue again. The residues are expressed as a percentage of the original tablet weight dosed.

The results for the tablets are presented below:

| Tablets | 1 | 2 | 3 | 4 |
|---|---|---|---|---|
| Weight (g) | 42.4 | 42.4 | 42.5 | 42.3 |
| $F_{max}$ (N) | 41.4 | 44.3 | 45.0 | 42.2 |
| $E_b$ (mJ) | 9.4 | 9.5 | 12.0 | 11.0 |
| Wet residue % | 51 | 32 | 16 | 23 |
| Dry Residue % | 29 | 22 | 10 | 15 |

These show that tablets of the invention have a much lower amount of residue when dispersed via a dispenser drawer than homogeneous tablets.

What is claimed is:

1. A detergent tablet having at least two discrete regions each compacted from particulate composition, wherein a first said region consists of a compacted particulate composition containing swelling disintegrant such that the region increases in volume on contact with water, and in at least one direction through said region is flanked on both sides by one or more other regions which swell to a lesser extent on contact with water than said first region, which tablet has a pair of opposite faces spaced apart from each other and joined by a peripheral surface of the tablet, wherein said first region provides a first part of a said face and said one or more further regions provide an adjoining part of said face.

2. A detergent tablet according to claim 1, wherein the one or more other regions contain a lower concentration of swelling disintegrant than the first region, or no swelling disintegrant.

3. A detergent tablet according to claim 2, wherein the one or more other regions contain the swelling disintegrant which is in the first region, where the concentration of said swelling disintegrant is lower in the one or more other regions than in the first region.

4. A detergent tablet according to claim 1, wherein the one or more other regions contain an equal or greater concentration of swelling disintegrant than the first region, but where said swelling disintegrant in the one or more other regions has a lower swelling capacity than the swelling disintegrant in the first region.

5. A detergent tablet according to claim 1, wherein there is a discontinuity at the junctions of the first and adjacent parts of said face.

6. A detergent tablet according to claim 5, wherein the first part of the said face is inset relative to the adjacent part of that face.

7. A detergent tablet according to claim 5, wherein the first part of the said face stands out relative to the adjacent part of that face.

8. A detergent tablet according to claim 1, wherein said first region is a core which is surrounded by said one or more other regions which provide the entire peripheral surface of the tablet.

9. A tablet according to claim 1 wherein the first region extends through the tablet so as to be exposed at both faces.

10. A tablet according to claim 8, wherein the first region extends through the tablet so as to be exposed at both faces.

11. A tablet according to claim 10, wherein the one or more regions of the tablet which are not the core consists of at least three layers, wherein a first of said layers swells to a greater extent on contact with water than the layers on either side of said first layer.

12. A tablet according to claim 1 wherein the said first part of a face of the tablet is between 10 and 35% of the area of the whole face.

13. A detergent tablet having at least two discrete regions each compacted from particulate composition, wherein a first said region consists of a compacted particulate composition containing swelling disintegrant such that the region increases in volume on contact with water, and in at least one direction through said region is flanked on both sides by one or more other regions which swell to a lesser extent on contact with water than said first region, which tablet comprises at least three layers, and the first region is a layer which is flanked by layers which swell to a lesser extent on contact with water than the first region.

14. A tablet according to claim 13, wherein the tablet consists of three layers.

15. A tablet according to claim 13, wherein the two layers either side of the layer which is the first region consist of the same composition as each other.

* * * * *